US011937637B2

(12) United States Patent
Potter et al.

(10) Patent No.: US 11,937,637 B2
(45) Date of Patent: Mar. 26, 2024

(54) AEROSOL SOURCE FOR A VAPOR PROVISION SYSTEM

(71) Applicant: NICOVENTURES TRADING LIMITED, London (GB)

(72) Inventors: Mark Potter, London (GB); Wade Tipton, London (GB); William Harris, London (GB); Christopher Rowe, London (GB); James Davies, London (GB); James Boonzaier, London (GB); Conor Devine, London (GB)

(73) Assignee: NICOVENTURES TRADING LIMITED, London (GB)

( * ) Notice: Subject to any disclaimer, the term of this patent is extended or adjusted under 35 U.S.C. 154(b) by 915 days.

(21) Appl. No.: 15/733,407

(22) PCT Filed: Jan. 23, 2019

(86) PCT No.: PCT/GB2019/050186
§ 371 (c)(1),
(2) Date: Jul. 22, 2020

(87) PCT Pub. No.: WO2019/145709
PCT Pub. Date: Aug. 1, 2019

(65) Prior Publication Data

US 2021/0093005 A1 Apr. 1, 2021

(30) Foreign Application Priority Data

Jan. 24, 2018 (GB) ..... 1801144

(51) Int. Cl.
*A24F 40/44* (2020.01)
*A24F 40/42* (2020.01)
(Continued)

(52) U.S. Cl.
CPC ..... *A24F 40/44* (2020.01); *A24F 40/42* (2020.01); *A24F 40/48* (2020.01); *A24F 40/485* (2020.01); *A24F 40/10* (2020.01); *A24F 40/20* (2020.01)

(58) Field of Classification Search
None
See application file for complete search history.

(56) References Cited

U.S. PATENT DOCUMENTS 8,061,361 B2 11/2011 Maeder et al.
9,254,007 B2 2/2016 Liu
(Continued)

FOREIGN PATENT DOCUMENTS

CN 201781984 U 4/2011
CN 201830900 U 5/2011
(Continued)

OTHER PUBLICATIONS

Communication pursuant to Article 94(3) EPC for Application No. 18715070.1, dated Nov. 2, 2020, 21 pages.
(Continued)

*Primary Examiner* — Tho D Ta
(74) *Attorney, Agent, or Firm* — Husch Blackwell LLP

(57) ABSTRACT

An aerosol source for a vapor provision system includes a vapor-generating element; a reservoir for holding source liquid, the reservoir being bounded by a wall having an opening therein; and a liquid transport element including a first portion arranged to receive liquid from the reservoir via the opening, a second portion peripheral to the first portion, and a third portion arranged to deliver liquid from the first portion to the vapor-generating element; wherein at least part of the second portion is compressed against a section of the wall around the opening, in use, to provide a sealing
(Continued)

effect around at least part of the first portion to promote movement of liquid towards the vapor-generating element.

18 Claims, 4 Drawing Sheets

(51) Int. Cl.

| | |
|---|---|
| ***A24F 40/48*** | (2020.01) |
| ***A24F 40/485*** | (2020.01) |
| *A24F 40/10* | (2020.01) |
| *A24F 40/20* | (2020.01) |

(56) References Cited

U.S. PATENT DOCUMENTS

| | | | | |
|---|---|---|---|---|
| 10,258,087 | B2 | 4/2019 | Kane | |
| 11,213,638 | B2 | 1/2022 | Nettenstrom et al. | |
| 11,388,931 | B2 | 7/2022 | Potter et al. | |
| 2011/0005535 | A1 | 1/2011 | Xiu | |
| 2013/0081642 | A1 | 4/2013 | Safari | |
| 2013/0087160 | A1 | 4/2013 | Gherghe | |
| 2013/0228191 | A1 | 9/2013 | Newton | |
| 2013/0263869 | A1* | 10/2013 | Zhu | A24F 40/485 131/329 |
| 2013/0306065 | A1 | 11/2013 | Thorens et al. | |
| 2014/0123989 | A1 | 5/2014 | Lamothe | |
| 2014/0130816 | A1 | 5/2014 | Liu | |
| 2014/0238423 | A1* | 8/2014 | Tucker | A24F 40/46 131/328 |
| 2014/0238424 | A1 | 8/2014 | Macko et al. | |
| 2015/0040927 | A1 | 2/2015 | Li et al. | |
| 2015/0144145 | A1 | 5/2015 | Chang et al. | |
| 2016/0015081 | A1 | 1/2016 | Liu | |
| 2016/0015082 | A1 | 1/2016 | Liu | |
| 2016/0073692 | A1 | 3/2016 | Alarcon et al. | |
| 2016/0121058 | A1 | 5/2016 | Chen | |
| 2016/0278163 | A1 | 9/2016 | Chen | |
| 2016/0286863 | A1 | 10/2016 | Lin | |
| 2016/0345632 | A1 | 12/2016 | Lipowicz | |
| 2017/0042242 | A1 | 2/2017 | Hon | |
| 2017/0127725 | A1 | 5/2017 | Buchberger et al. | |
| 2017/0273359 | A1 | 9/2017 | Liu | |
| 2017/0303596 | A1 | 10/2017 | Chen | |
| 2020/0352238 | A1 | 11/2020 | Simpson et al. | |
| 2021/0145055 | A1 | 5/2021 | Potter et al. | |

FOREIGN PATENT DOCUMENTS

| | | | | |
|---|---|---|---|---|
| CN | 103380952 | A | 11/2013 | |
| CN | 204120237 | U | 1/2015 | |
| CN | 104366695 | A | 2/2015 | |
| CN | 104720117 | A | 6/2015 | |
| CN | 204426699 | U | 7/2015 | |
| CN | 204483035 | U | 7/2015 | |
| CN | 105163614 | A | 12/2015 | |
| CN | 105188428 | A | 12/2015 | |
| CN | 105208882 | A | 12/2015 | |
| CN | 105342010 | A | 2/2016 | |
| CN | 105433442 | A | 3/2016 | |
| CN | 205285008 | U | 6/2016 | |
| CN | 205512338 | U | 8/2016 | |
| CN | 106376976 | A | 2/2017 | |
| CN | 106535682 | A | 3/2017 | |
| CN | 206119177 | U | 4/2017 | |
| CN | 206197019 | U | 5/2017 | |
| CN | 206197020 | U | 5/2017 | |
| CN | 107708452 | A | 2/2018 | |
| EP | 2460424 | A1 | 6/2012 | |
| EP | 2823720 | A1 | 1/2015 | |
| EP | 2959784 | A1 | 12/2015 | |
| EP | 2984952 | A1 | 2/2016 | |
| EP | 3108759 | A1 | 12/2016 | |
| GB | 2513639 | A | 11/2014 | |
| JP | 2017514504 | A | 6/2017 | |
| KR | 20120098343 | A | 9/2012 | |
| KR | 20140002774 | U | 5/2014 | |
| RU | 2425608 | C2 | 8/2011 | |
| RU | 2606572 | C2 | 1/2017 | |
| RU | 2620754 | C2 | 5/2017 | |
| RU | 2639972 | C2 | 12/2017 | |
| WO | WO-2011146375 | A2 | 11/2011 | |
| WO | WO-2016041209 | A1 * | 3/2016 | A24F 47/00 |
| WO | WO-2016079151 | A1 | 5/2016 | |
| WO | WO-2016090531 | A1 * | 6/2016 | A24F 47/00 |
| WO | WO-2016176800 | A1 | 11/2016 | |
| WO | WO-2016190222 | A1 | 12/2016 | |
| WO | WO-2016198417 | A1 | 12/2016 | |
| WO | WO-2016207357 | A1 | 12/2016 | |
| WO | WO-2016208756 | A1 | 12/2016 | |
| WO | WO-2017001818 | A1 | 1/2017 | |
| WO | WO-2017001819 | A1 | 1/2017 | |
| WO | WO-2017015832 | A1 | 2/2017 | |
| WO | WO-2017215221 | A1 | 12/2017 | |

OTHER PUBLICATIONS

International Preliminary Report on Patentability for Application No. PCT/GB2018/050726, dated Jul. 3, 2019, 32 pages.
International Preliminary Report on Patentability for Application No. PCT/GB2019/050037, dated May 8, 2020, 21 pages.
International Preliminary Report on Patentability for Application No. PCT/GB2019/050186, dated May 8, 2020, 8 pages.
International Preliminary Report on Patentability for Application No. PCT/GB2019/050187 dated Aug. 6, 2020, 8 pages.
International Preliminary Report on Patentability for Application No. PCT/GB2019/050187 dated Jul. 28, 2020, 7 pages.
International Search Report and Written Opinion for Application No. PCT/GB2018/050726, dated Jun. 12, 2018, 15 pages.
International Search Report and Written Opinion for Application No. PCT/GB2019/050037, dated Mar. 25, 2019, 12 pages.
International Search Report for Application No. PCT/GB2019/050187, dated Apr. 18, 2019, 3 pages.
Notice of Reasons for Rejection for Japanese Application No. 2020-539826, dated Jun. 15, 2021, 14 pages.
Office Action for Canadian Application No. 3089292, dated Dec. 16, 2021, 6 pages.
Office Action For Chinese Application No. 201880020522.4, dated Aug. 3, 2021, 14 pages.
Office Action For Chinese Application No. 201880020522.4, dated May 20, 2022, 12 pages.
Office Action for Japanese Patent Application No. 2020-537201, dated Jul. 13, 2021, 5 pages.
Office Action For Korean Application No. 10-2019-7027899, dated Jan. 18, 2021, 17 pages.
Office Action For Korean Application No. 10-2019-7027899, dated Jul. 27, 2021, 15 pages.
Office Action For Russian Application No. 2020124567, dated Jan. 28, 2021, 2 pages.
Search Report for Russian Application No. 2020124379 dated Mar. 2, 2021, 2 pages.
Search Report dated Apr. 27, 2017 for Great Britain Application No. GB1704674.9, 5 pages.
Search Report dated May 31, 2017 for Great Britain Application No. GB1702861.4, 5 pages.
Second Office Action dated Jan. 20, 2022 for Chinese Application No. 201880020522.4, 17 pages.
"International Search Report and Written Opinion received for PCT Patent Application No. PCT/GB2019/050089, dated Mar. 25, 2019", 10 pages.
"Notice of Allowance received for Korean Patent Application No. 10-2020-7021264, dated Nov. 14, 2022", 6 pages (3 pages of English Translation and 3 pages of Official).
"Office Action received for Chinese Patent Application No. 201980009907.5, dated Nov. 2, 2022", 17 pages (9 pages of English Translation and 8 pages of Official).

* cited by examiner

AEROSOL SOURCE FOR A VAPOR PROVISION SYSTEM

PRIORITY CLAIM

The present application is a National Phase entry of PCT Application No. PCT/GB2019/050186, filed Jan. 23, 2019, which claims priority from GB Patent Application No. 1801144.5, filed Jan. 24, 2018, which is hereby fully incorporated herein by reference.

TECHNICAL FIELD

The present disclosure relates to an aerosol source for an electronic vapor provision system such as an e-cigarette.

BACKGROUND

Many electronic vapor provision systems, such as e-cigarettes and other electronic nicotine delivery systems that deliver nicotine via vaporized liquids, and hybrid devices which additionally include a portion of tobacco or other flavor element through which vapor generated from a liquid is passed, are formed from two main components or sections, namely a cartomizer and a control unit (battery section). The cartomizer generally includes a reservoir of liquid and an atomizer for vaporizing the liquid. These parts may collectively be designated as an aerosol source. The atomizer may be implemented as an electrical (resistive) heater, such as a wire formed into a coil or other shape, and a wicking element in proximity to the heater which transports liquid from the reservoir to the heater. The control unit generally includes a battery for supplying power to the atomizer. Electrical power from the battery is delivered to the heater, which heats up to vaporize a small amount of liquid delivered by the wicking element from the reservoir. The vaporized liquid is then inhaled by the user.

The reservoir has an at least one opening by which liquid can leave the reservoir to flow along the wicking element. Leakage may occur at this opening. Also, sometimes the wicking element may absorb more liquid than the heater is able to vaporize, for example in the event of environmental pressure changes or physical shocks. This gives an excess of free liquid in the wicking element, which can result in leakage. Liquid may drip from the base of the atomizer, for example. Accordingly, approaches for reducing liquid leaks are of interest.

SUMMARY

According to a first aspect of some embodiments described herein, there is provided an aerosol source for a vapor provision system comprising: a vapor-generating element; a reservoir for holding source liquid, the reservoir being bounded by a wall having an opening therein; and a liquid transport element comprising a first portion arranged to receive liquid from the reservoir via the opening, a second portion peripheral to the first portion, and a third portion arranged to deliver liquid from the first portion to the vapor-generating element; wherein at least part of the second portion is compressed against a section of the wall around the opening, in use, to provide a sealing effect around at least part of the first portion to promote movement of liquid towards the vapor-generating element.

According to a second aspect of some embodiments described herein, there is provided a vaporizer for a vapor provision system comprising a vapor-generating element for generating vapor from a liquid; and a liquid transport element comprising a first portion configured to receive liquid from a reservoir via an opening in a wall of the reservoir, a second portion peripheral to the first portion and configured for compression against a section of wall around the opening, and a third portion configured to deliver liquid from the first portion to the vapor-generating element.

According to a third aspect of some embodiments described herein, there is provided a liquid transport element for a vapor provision system comprising a first portion configured to receive liquid from a reservoir via an opening in a wall of the reservoir, a second portion peripheral to the first portion and configured for compression against a section of wall around the opening, and a third portion configured to deliver liquid from the first portion to a vapor generating element configured to generate vapor from the liquid.

According to a fourth aspect of some embodiments described herein, there is provided a cartomizer for a vapor provision system comprising an aerosol source according to the first aspect, a vaporizer according to the second aspect or a liquid transport element according to the third aspect.

According to a fifth aspect of some embodiments described herein, there is provided a vapor provision system comprising an aerosol source according to the first aspect, a vaporizer according to the second aspect, a liquid transport element according to the third aspect, or a cartomizer according to the fourth aspect.

According to a sixth aspect of some embodiments described herein, there is provided a vapor provision system comprising: a reservoir containing liquid; a vapor generator; and a wicking element arranged to transport liquid from the reservoir to the vapor generator for vaporization to generate a vapor for user inhalation, the wicking element comprising a first section arranged to receive liquid from within the reservoir and a second section arranged to provide liquid to the vapor generator; wherein the first section of the wicking element comprises a flat surface compressed against a section of a wall of the reservoir around an opening in the wall through which the first section receives the liquid so the compressed portion of the wicking element forms a seal at least partially around the opening.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, an aerosol source or a vapor provision system including an aerosol source may be provided in accordance with approaches described herein which includes any one or more of the various features described below as appropriate.

BRIEF DESCRIPTION OF THE DRAWINGS

Various embodiments of the disclosure will now be described in detail by way of example only with reference to the following drawings in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapor provision systems, such as e-cigarettes. Throughout the following description the terms "e-cigarette" and "electronic cigarette" may sometimes be used; however, it will be appreciated these terms may be used interchangeably with aerosol (vapor) provision system or device. The disclosure is also applicable to hybrid devices and systems configured to deliver nicotine or other substances by vaporizing liquid and passing the vapor through a solid substrate such as tobacco. The various terms noted above should be understood to include such devices. Similarly, "aerosol" may be used interchangeably with "vapor".

As used herein, the term "component" is used to refer to a part, section, unit, module, assembly or similar of an electronic cigarette that incorporates several smaller parts or elements, often within an exterior housing or wall. An electronic cigarette may be formed or built from one or more such components, and the components may be removably connectable to one another, or may be permanently joined together during manufacture to define the whole electronic cigarette.

Figure 1:
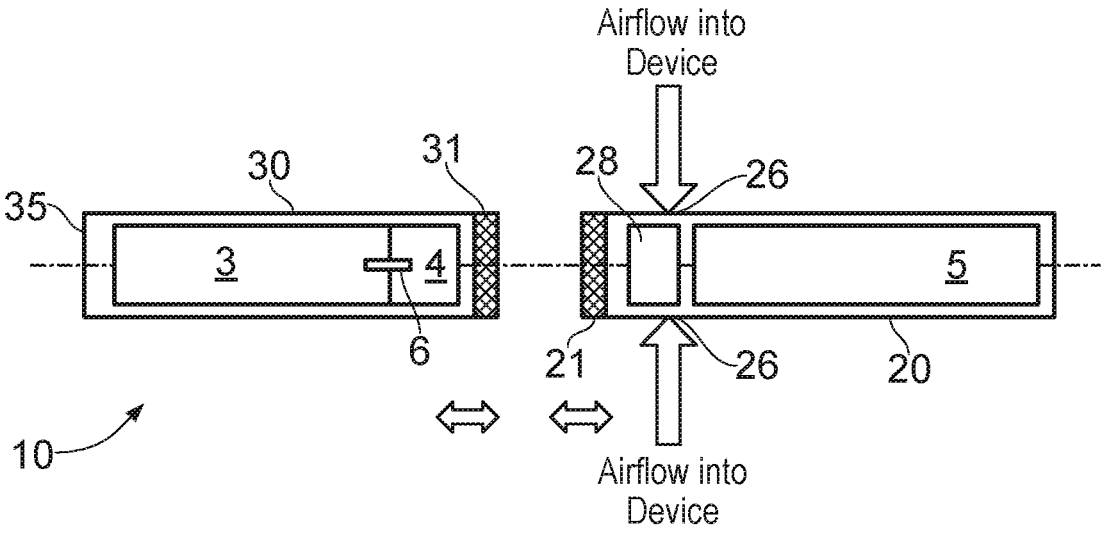
FIG. 1 shows a cross-section through an example e-cigarette comprising a cartomizer and a control unit in which examples may be implemented.

FIG. 1 is a highly schematic diagram (not to scale) of an example aerosol/vapor provision system such as an e-cigarette 10. The e-cigarette 10 has a generally cylindrical shape, extending along a longitudinal axis indicated by a dashed line, and comprises two main components, namely a control or power component or section 20 and a cartridge assembly or section 30 (sometimes referred to as a cartomizer, clearomizer or atomizer) that operates as a vapor-generating component.

The cartridge assembly 30 includes a reservoir 3 containing a source liquid comprising a liquid formulation from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavorings. Nicotine-free source liquid may also be used, such as to deliver flavoring. A solid substrate (not illustrated) such as a portion of tobacco or other flavor element through which vapor generated from the liquid is passed, may also be included. The reservoir 3 has the form of a storage tank, being a container or receptacle in which source liquid can be stored such that the liquid is free to move and flow within the confines of the tank. Alternatively, the reservoir 3 may contain a quantity of absorbent material such as cotton wadding, glass fiber or porous ceramic which holds the source liquid within a porous structure. The reservoir 3 may be sealed after filling during manufacture so as to be disposable after the source liquid is consumed, or may have an inlet port or other opening through which new source liquid can be added. The cartridge assembly 30 also comprises an electrical heating element or heater 4 located externally of the reservoir tank 3 for generating the aerosol by vaporization of the source liquid by heating. A liquid transfer arrangement (liquid transport element) such as a wick or other porous element 6 may be provided to deliver source liquid from the reservoir 3 to the heater 4. The wick 6 has one or more parts located inside the reservoir 3, or otherwise in fluid communication with the liquid in the reservoir 3, so as to be able to absorb source liquid and transfer it by wicking or capillary action to other parts of the wick 6 that are in contact with the heater 4. This liquid is thereby heated and vaporized, to be replaced by new source liquid transferred to the heater 4 by the wick 6. The wick may be thought of as a bridge, path or conduit between the reservoir 3 and the heater 4 that delivers or transfers liquid from the reservoir to the heater. Terms including conduit, liquid conduit, liquid transfer path, liquid delivery path, liquid transfer mechanism or element, and liquid delivery mechanism or element may all be used interchangeably herein to refer to a wick or corresponding component or structure.

A heater and wick (or similar) combination is sometimes referred to as an atomizer or atomizer assembly, and the reservoir with its source liquid plus the atomizer may be collectively referred to as an aerosol source. Other terminology may include a liquid delivery assembly, a liquid transfer assembly, or simply assembly, where in the present context these terms may be used interchangeably to refer to a vapor-generating element (vapor generator) and a wicking or similar component or structure (liquid transport element) that delivers or transfers liquid from a reservoir to the vapor generator. Various designs are possible, in which the parts may be differently arranged compared with the highly schematic representation of FIG. 1. For example, the wick 6 may be an entirely separate element from the heater 4, or the heater 4 may be configured to be porous and able to perform at least part of the wicking function directly (a metallic mesh, for example). Other means for vapor generation may be used in place of a heater, such a vibrating vaporizer based on the piezoelectric effect, for example. In an electrical or electronic device, the vapor generator may be an electrical heating element that operates by ohmic (Joule) heating or by inductive heating. Also, the device may a non-electrical device, that operates by pump-action, for example. In general, therefore, an atomizer can be considered to be a vapor-generating or vaporizing element able to generate vapor from source liquid delivered to it, and a liquid transport element able to deliver or transport liquid from a reservoir or similar liquid store to the vapor generator by a wicking action/capillary force. Embodiments of the disclosure are applicable to all and any such assembly configurations. Regardless of the implementation, the parts will be configured to form a liquid flow path by which the source liquid is able to travel from the interior of the reservoir 3 to the vicinity and surface of the heater 4 (or other vapor generator) for vaporization. This is the intended fluid path, whereby liquid is delivered to the heater and should be successfully vaporized and thereby prevented from forming a leak by which liquid may escape into other locations inside or outside the electronic cigarette. This operation is based on a delivery of source liquid at an expected rate such that the vapor generator can handle the incoming liquid. However, in the event of leakage such as may be caused by excess pressure inside the reservoir, or even under normal pressure conditions when the vapor generator is not operating, too much liquid may accumulate in or at the wicking element and then drip away to escape as free liquid in a chamber housing the atomizer.

Returning to FIG. 1, the cartridge assembly 30 also includes a mouthpiece 35 having an opening or air outlet through which a user may inhale the aerosol generated by the heater 4.

The power component 20 includes a cell or battery 5 (referred to herein after as a battery, and which may be re-chargeable) to provide power for electrical components of the e-cigarette 10, in particular the heater 4. Additionally, there is a printed circuit board 28 and/or other electronics or circuitry for generally controlling the e-cigarette. The control electronics/circuitry connect the heater 4 to the battery 5 when vapor is required, for example in response to a signal from an air pressure sensor or air flow sensor (not shown) that detects an inhalation on the system 10 during which air enters through one or more air inlets 26 in the wall of the power component 20. When the heating element 4 receives power from the battery 5, the heating element 4 vaporizes source liquid delivered from the reservoir 3 by the wick 6 to generate the aerosol, and this is then inhaled by a user through the opening in the mouthpiece 35. The aerosol is carried from the aerosol source to the mouthpiece 35 along an air channel (not shown) that connects the air inlet 26 to the aerosol source to the air outlet when a user inhales on the mouthpiece 35. An air flow path through the electronic cigarette is hence defined, between the air inlet(s) (which may or may not be in the power component) to the atomizer and on to the air outlet at the mouthpiece. In use, the air flow direction along this air flow path is from the air inlet to the air outlet, so that the atomizer can be described as lying downstream of the air inlet and upstream of the air outlet.

In this particular example, the power section 20 and the cartridge assembly 30 are separate parts detachable from one another by separation in a direction parallel to the longitudinal axis, as indicated by the solid arrows in FIG. 1. The components 20, 30 are joined together when the device 10 is in use by cooperating engagement elements 21, 31 (for example, a screw or bayonet fitting) which provide mechanical and electrical connectivity between the power section 20 and the cartridge assembly 30. This is merely an example arrangement, however, and the various components may be differently distributed between the power section 20 and the cartridge assembly section 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted (the reservoir is empty or the battery is flat, for example), or be intended for multiple uses enabled by actions such as refilling the reservoir and recharging the battery. Alternatively, the e-cigarette 10 may be a unitary device (disposable or refillable/rechargeable) that cannot be separated into two parts, in which case all components are comprised within a single body or housing. Embodiments and examples of the present disclosure are applicable to any of these configurations and other configurations of which the skilled person will be aware.

Figure 2:
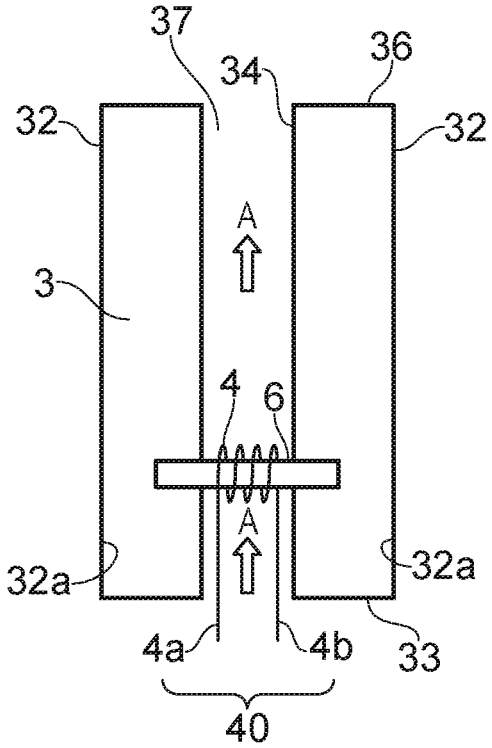
FIG. 2 shows a cross-sectional side view of a vapor-generating assembly including a reservoir, wick and heater.

The example device in FIG. 1 is presented in a highly schematic format. FIG. 2 shows a more detailed representation of an aerosol source indicating example positions of a tank, a heater and a wick.

FIG. 2 shows a cross-sectional side view of an example aerosol source. A reservoir tank 3 has an outer wall 32 and an inner wall 34, each of which is generally tubular. The inner wall 34 is centrally disposed within the outer wall 32 to define an annular space between the two walls; this is the interior volume of the tank 3 intended to hold source liquid. The tank is closed at its lower end (in the orientation depicted) by a bottom wall 33 and at its top end by an upper wall 36. The central space encompassed by the inner wall 34 is a passage or channel 37 which at its lower end receives air drawn into the electronic cigarette (such as via air intakes 26 shown in FIG. 1), and at its upper end delivers aerosol for inhalation (such as through the mouthpiece 35 in FIG. 1). It also defines a chamber housing the atomizer.

Disposed within the airflow channel 37 is the atomizer 40 comprising a heater 4 and a wick 6. The wick, an elongate porous element that in this example is rod-shaped and may be formed from multiple fibers, is arranged across the airflow passage (shown as closer to the lower end of the tank 3, but it may be positioned higher) so that its ends pass through apertures in the inner wall 34 and reach into the interior volume of the tank 3 to absorb source liquid therein. The heater 4 is an electrically powered heating element in the form of a wire coil wrapped around the wick 6. Connecting leads 4*a*, 4*b* join the heater 4 to a circuit (not shown) for the provision of electrical power from a battery. The aerosol source will be disposed within the housing of a cartridge assembly section of an electronic cigarette, with a mouthpiece arranged at its top end and a controller and battery arranged at its lower end (possibly in a separable component). Note that the outer wall 32 of the tank 3 may or may not also be a wall of the cartridge assembly housing. If these walls are shared, the cartridge assembly may be intended to be disposable when the source liquid has been consumed, to be replaced by a new cartridge assembly connectable to an existing battery/power section, or may be configured so that the reservoir tank 3 can be refilled with source liquid. If the tank wall and the housing wall are different, the tank 3 or the whole aerosol source may be replaceable within the housing when the source liquid is consumed, or may be removable from the housing for the purpose of refilling. These are merely example arrangements and are not intended to be limiting.

In use, when the aerosol source within its assembly housing is joined to a battery section (separably or permanently depending on the e-cigarette design), and a user inhales through the mouthpiece, air drawn into the device through an inlet or inlets enters the airflow channel 37. The heater 4 is activated to produce heat; this causes source liquid brought to the heater 4 by the wick 6 to be heated to vaporization. The vapor is carried by the flowing air further along the airflow channel 37 to the mouthpiece of the device to be inhaled by the user. The arrows A indicate the airflow and its direction along the air flow path through the device.

It will be appreciated that such an arrangement is potentially vulnerable to leaks. Leakage of the liquid directly from the reservoir 3 through the apertures by which the wick 6 enters the tank interior may occur. Also, if the wick absorbs more liquid than can be removed by the vaporization action, this liquid may drip from the wick 6. In such ways, free liquid may arrive into the airflow channel 37, where it might be inhaled by the user together with the vapor, thereby spoiling the vaping experience, or might travel downwards to leak altogether out of the electronic cigarette, soiling the user or his possessions, or to contaminate other parts of the electronic cigarette such as the battery or the control electronics.

To address this, the present disclosure proposes an alternative arrangement for the wick (wicking element or liquid transport element). Instead of the wick having a portion or portions that reaches into the interior of the reservoir, the wick, formed from a porous material, is disposed externally to the reservoir, on the opposite side of the reservoir boundary wall to the source liquid held in the reservoir. An opening or aperture in the reservoir wall allows liquid to feed onto the wick, which is placed over the opening. A portion of the wick around the area which receives the liquid is placed in compression against the reservoir wall around the opening to provide a sealing effect. In this way, some containment of the liquid leaving the reservoir through the opening is provided.

Figure 3:
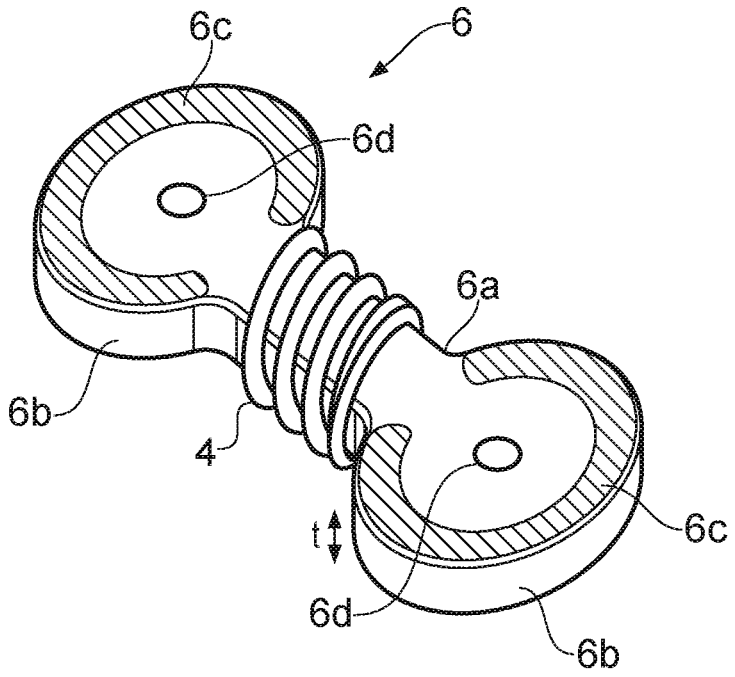
FIG. 3 shows a perspective view of an example atomizer.

FIG. 3 shows a perspective view of an example atomizer (wick plus heater) in which the wick 6 is configured for use in this manner. In this example the wick 6, made from a porous material, is shaped as a planar element with a length and a width, and having a thickness t orthogonal to the plane of the wick. The wick 6 has a "dumbbell" or "dog bone" shape, in that it has a narrow central part 6*a*, and two enlarged end parts 6*b* which are wider in the plane of the wick than the central part 6*a*, with both the end parts 6*b* and the central part 6*a* having the same or similar thickness t (or at least that the thickness t is less than or much less than the length). The central part 6*a* has a heater 4 associated with it, which in this example is a wire heating coil comprising coils wrapped around the central part 6*a* of the wick 6. This portion of the atomizer will be disposed in the airflow channel of a vapor-generating component of an assembled electronic cigarette. Each of the end parts 6*b* is intended to receive liquid from a reservoir, specifically in the areas 6*d* marked as small circles in FIG. 3 which are towards the center of each end part 6*b*. These liquid receiving areas 6*d* are placed over, across or against openings in the wall of a reservoir, so that liquid can flow out of the reservoir and onto the wick 6. Wicking or capillary action in the porous structure of the wick 6 conveys liquid from the liquid receiving areas 6*d* through the end parts 6*b* and into and along the central part 6*a*, to the vicinity of the heater 4 for vaporization.

In addition, the end parts 6*b* of the wick 6 include compression regions 6*c*, shown in FIG. 3 by shading. These are regions of the wick 6 which, when the wick is installed to receive liquid from openings in a reservoir, will be compressed against the wall of the reservoir generally around each opening. The compression is in the direction of the wick thickness t, substantially perpendicular to the plane of the wick. In the FIG. 3 example, this arrangement is embodied by the perimeter of the end parts 6*b* being the compression regions 6*c*, and the liquid receiving areas 6*d* being at or near the center of the end parts 6*b*, so that a compressed part 6*c* of the wick largely surrounds each liquid receiving area 6*d*. A gap in the compression region, so that the compression region 6*c* does not completely encircle or encompass the liquid receiving area 6*d*, is left where the central part 6*a* joins to the end part 6*b* to provide a liquid flow path from the liquid receiving area 6*d* to the heater 4 which does not include compressed wick material.

The compression of the wick material in its thickness direction has the effect of closing, or at least reducing the size of, the pores of the wick material in the compression regions. This reduces or removes the wicking and absorption capability of the wick material so that liquid flow is impeded. The compressed material forms a barrier or partial barrier to the movement of liquid within the wick. Liquid flow can thereby be directed as it is intended, namely towards the heater 4, and leakage in other directions can be reduced.

Figure 4:
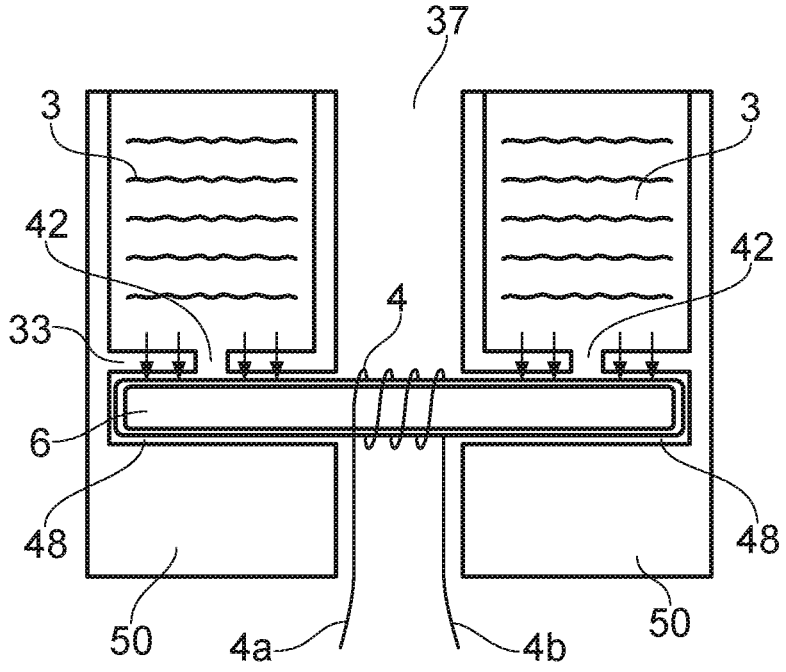
FIG. 4 shows a cross-sectional side view of a vapor-generating assembly including an atomizer such as the FIG. 3 example.

FIG. 4 shows a cross-sectional schematic side view of the wick 6 of FIG. 3 installed in association with a reservoir 3. The reservoir 3 is shaped similarly to that of FIG. 2, in that it is annular with a central air flow passage 37 across which the wick 6 extends, the heater 4 being disposed in this passage 37. Note that only the lower part of the tank/reservoir 3 is shown; in reality it will be closed at its upper end as in FIG. 2.

The reservoir has a lower, base wall 33 as before, and in this are provided two openings 42, which are oppositely arranged across the passage 37. The wick 6 is installed such that its end parts 6*b* overlay the base wall 33, with the liquid receiving areas 6*d* in line with the openings 42. The openings 42 are thereby covered by the end parts of the wick. Liquid can flow out of the reservoir 3 via the openings 42 and into the wick 6. Around each of the openings 42, the material of the wick in the compression regions 6*c* is compressed in the direction of the wick's thickness; this is represented by the arrows in FIG. 4.

In this example, the compression of the wick is provided by a compression body 50 arranged on an opposite surface of the wick 6 to the base wall 33 of the reservoir 3. The compression body 50 is positioned spaced apart from the base wall 33 to leave a cavity 48 in which the wick 6 is located. In the areas of the compression regions 6*c* of the wick 6, the compression body 50 is spaced apart from the base wall 33 by a distance less than the thickness t of the wick, so that the wick material is squeezed against the base wall 33 by the compression body 50. The compression body 50 might be formed integrally with the walls of the reservoir 3, for example by molding or machining a plastics or metal material onto the reservoir wall(s), and the wick 6 then inserted into the cavity 48. Alternatively, the compression body 50 may be formed separately from the reservoir 3, so that the wick 6 is laid over the base wall 33 and the compression body 50 is then secured to the reservoir 3 at the appropriate spacing to form the cavity 48, or the wick 6 can be layered on the appropriate surface of the compression body 50 and the two parts secured at the proper spacing from the reservoir base wall 33. The compression body may be joined to the reservoir, as in FIG. 4, or might be integral with a different component of the electronic cigarette so that it is correctly positioned to define the cavity 48 and create the required compression of the wick 6 when that component is assembled with the reservoir 3. In any case, the wick 6 may be inserted into the cavity 48 after the cavity is defined, or may be layered with the base wall 33 or the compression body 50 before the parts are assembled together.

FIG. 4 shows the wick 6 positioned in the cavity 48 but does not illustrate any reduced thickness of the wick resulting from compression in the areas marked by the arrows. In reality, the compressed parts of the wick are made thinner than the uncompressed parts. This can be achieved by surface features on one or both of the compression body and the reservoir wall which protrude into the cavity over the area of the compression regions. The depth of the cavity is thus reduced where the surface features are located, and the wick material is squashed, squeezed or otherwise compressed between the surface features (if they are on both sides) or between a surface feature on one side and the base wall or the compression body on the other side.

Figure 5:
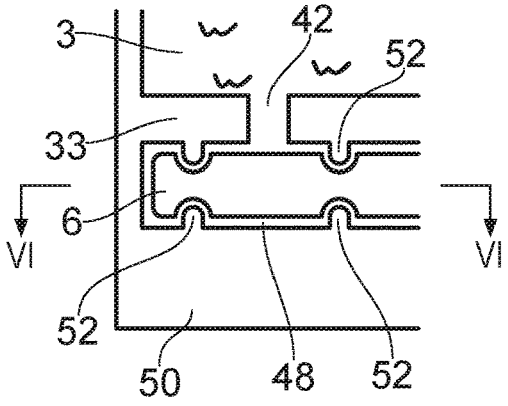
FIG. 5 shows a cross-sectional side view of part of another example vapor-generating assembly.

FIG. 5 shows a schematic cross-sectional view of part of a wick and reservoir, configured with protruding surface features to provide wick compression. In this example, both the base wall 33 of the reservoir 3 and the compression body 50 are provided with surface protrusions 52 facing inwardly into the cavity 48 formed between the base wall 33 and the compression body 50. The protrusions 52 are positioned opposite to each other across the cavity 48 and partially surround the opening 42 in the base wall 33, and are spaced somewhat from the opening 42 in this example (in other words, they are not immediately adjacent to the opening 42). The opposite protrusions 52 are separated by a distance less than the thickness t of the wick 6, so that the wick 6, when installed in the cavity 48 across the opening 42, is compressed in its thickness direction in a region around the opening 42 by the protrusions 52.

Figure 6:
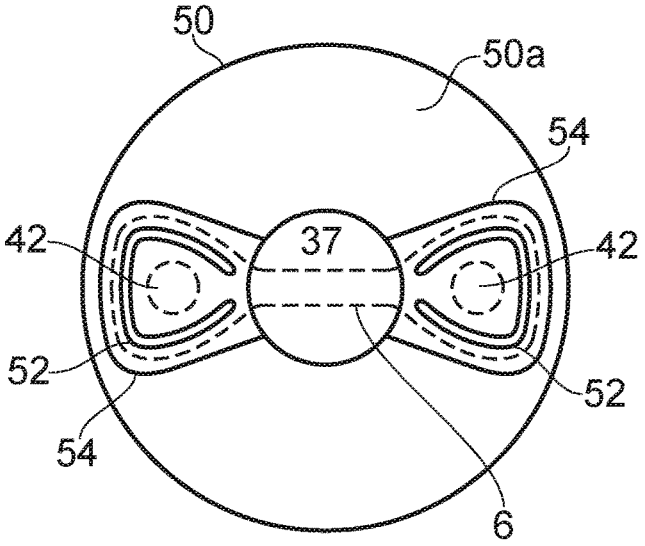
FIG. 6 shows a plan view of a compression body comprised in an assembly such as that of FIG. 4.

FIG. 6 shows plan view of the compression body 50 viewed in the direction of the arrows VI in FIG. 5. The surface 50*a* which in use faces the base wall 33 of the reservoir 3 has formed in it two diametrically opposed recesses 54. These cooperate with the base wall to form the cavity for the wick 6. (Conversely, recesses might be provided in the base wall to cooperate with a flat compression body, or both parts might have recesses.) An arcuate protrusion 52 is formed inside each recess, aligned where the compression of the wick is required, namely almost but not completely surrounding the corresponding opening in the base wall. The positions of the wick 6 and the openings 42 in the base wall are shown in phantom.

A wick in accordance with the current disclosure is not limited to the FIG. 3 example, and we may usefully describe a wick in more general terms to indicate the various parts included to implement a compression sealing functionality.

Figure 7:
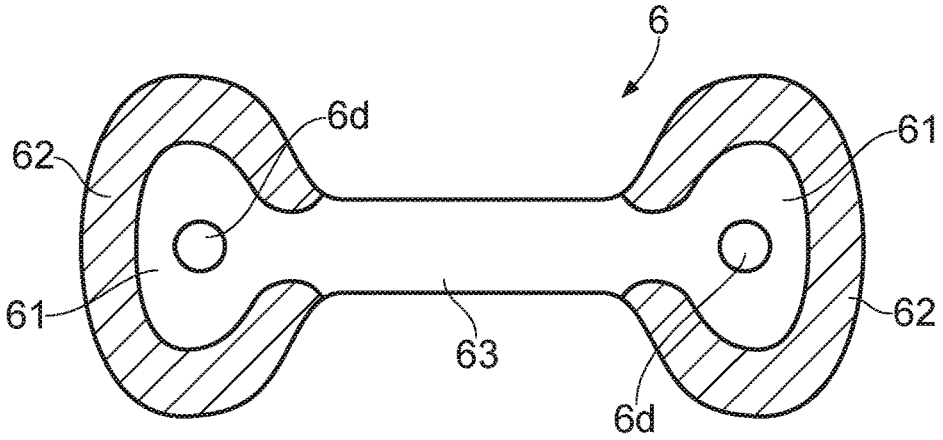
FIG. 7 shows an plan view of an example wick.

FIG. 7 shows a plan view of an example wick 6 comprising various portions. This example again is planar and has a dumbbell shape in that plane. The enlarged parts at each end of the wick 6 each comprise a first portion 61 which is intended to be placed across an opening in a reservoir wall to receive liquid through that opening. The area of the first portion 61 for direct alignment with the opening comprises a liquid receiving area 6*d*, and in this example, the first portion 61 extends beyond the liquid receiving area 6*d*, the material of the first portion 61 receiving liquid from the liquid receiving area 6*d* by a wicking action. Hence the first portion has a larger area than the liquid receiving area 6*d* and the reservoir opening. Peripheral to each first portion 61 is a second portion 62 (shown by shading), which is located around an edge of the enlarged ends of the wick. The second portion 62 is the area of the wick 6 which is compressed when the wick is installed. The central narrow part of the wick 6, joining the two enlarged ends, is a third portion 63, which delivers liquid to a vapor-generating element such as a heater. In this example, the third portion 63 is directly contiguous with the first portions 61, via a gap in encircling arcs of the second portions 62 which otherwise surround the first portions 61. Liquid that enters the first portion 61 at the liquid receiving area 6*d* moves through the pores of the wick material in the first portion by capillary wicking to the third portion 63. In this way, liquid travels from the reservoir to the vapor-generating element. Liquid moving in other directions from the liquid receiving area 6*d* will be impeded by the compressed material of the second portion 62. Hence, the compression provides a sealing effect that inhibits or prevents movement of the liquid in directions other than towards the third portion and the associated vapor-generating element. The seal acts to direct the liquid in the first portion towards the vapor-generating element, thereby promoting or enhancing movement of liquid in this direction. Leakage of liquid away from the vapor-generating element can thereby be reduced.

Use of the terms "first portion", "second portion" and third portion" are not intended to be limiting, or to imply any particular physical or structural difference or separation between the various portions of the wick (although the wick might be made from a single piece of material or from separate pieces joined together). The terms are convenient labels to indicate parts of a wick that primarily perform particular functions, in other words, the receipt of liquid from the reservoir, the compression for sealing, and the provision of liquid to the vapor-generating element. In any wick, the various portions might be clearly distinct, or might blend or overlap with adjacent portions, if functions are shared. For example, the absorption of liquid at the reservoir opening, transport of liquid away from the opening and towards to the vapor-generating element, and delivery of liquid to the immediate vicinity of the vapor-generating region where it can be vaporized might be considered to all occur within a same portion of a wick, so that the first portion and the third portion can be considered to be the same, or coincident. The boundary between these various liquid movement operations might be indistinct, so that the first portion and the third portion overlap, or share material of the wick.

Other shapes and configurations of wick may be used. A plurality of double-ended shapes similar to the FIG. 7 example may be used, where each end has a liquid receiving area. For example, the wick may be shaped, in its plane, as a bow-tie or as a dog-bone. Also, the two enlarged ends need not be the same shape or size. More complicated three- or four-ended shapes might be used, so as to receive liquid at more than two areas, from a reservoir with more than two openings in its wall.

Figure 8:
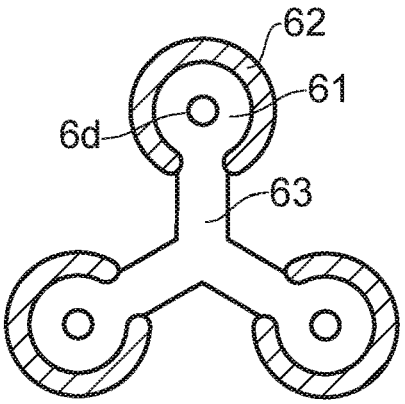
FIG. 8 shows a plan view of a further example wick.
Figure 9:
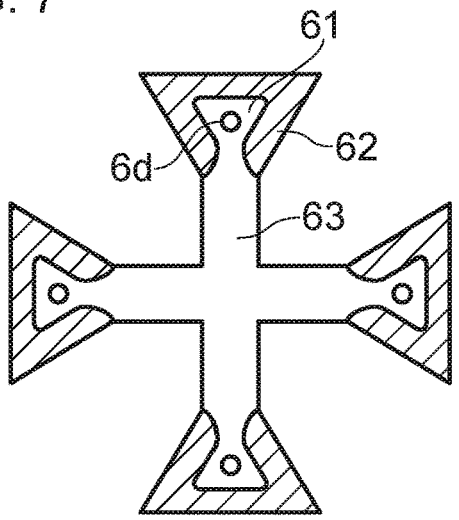
FIG. 9 shows a plan view of a still further example wick.

FIG. 8 shows a three-ended form of wick with round enlarged ends, and FIG. 9 shows a four-ended wick in the form of a cross with triangular enlarged ends. Further ends might be added if desired. Such wicks might deliver liquid to vapor-generating elements comprising one or more heating coils, where the arms of the third portion 63 may or may not each be wrapped by a heating coil or part of a heating coil.

The second portion or portions of the wick, being the region which is compressed to form a seal, may be spaced apart from the liquid receiving area (so that the first region is larger than the liquid receiving area) as shown thus far, or may commence immediately adjacent to the liquid receiving area, so that the first region is the same shape and size as the reservoir wall opening.

Figure 10:
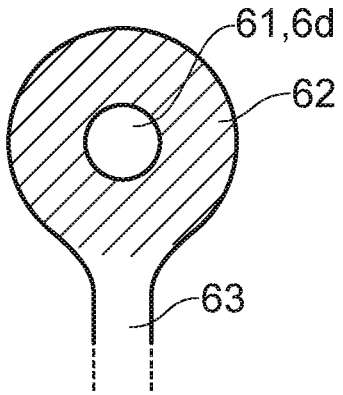
FIG. 10 shows a plan view of part of a yet further example wick.

FIG. 10 shows one end of a wick configured in this way. A feature of such an arrangement is that there is no need for shaped protrusions on the reservoir base wall or the compression body. Instead, the two facing surfaces may be flat and act to provide the compression if the base wall and the compression body are spaced apart by less than the thickness of the wick (so the depth of the cavity as a whole is less than the wick thickness). The wick end becomes compressed at all parts except for the liquid receiving area, where the presence of the opening in the reservoir wall provides no compression. Hence, the first portion of the wick is the same size and shape as the opening.

Figure 11:
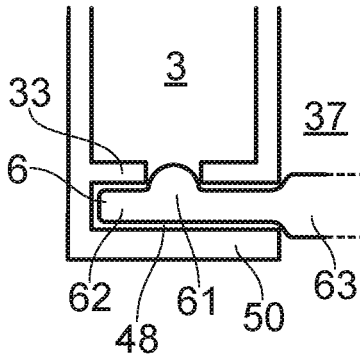
FIG. 11 shows a cross-sectional side view of part of a further example vapor-generating assembly.

FIG. 11 shows a cross-sectional side view of a wick installed in this way. Compression of the wick across all of the end by the facing surfaces of the reservoir end wall 33 and compression body 50 reduces the thickness of the wick more widely than in previous examples, and the wick bulges up into the opening 42 where it is not compressed, and also as it emerges from the cavity 48 into the airflow channel 37.

It will be noted in this example that the second portion 62 of the wick completely surrounds the first portion 61, and the third portion 63 is contiguous with the second portion 62 instead of contiguous with the first portion 61 as in the FIG. 7 example. Appropriate choices of the wick material and the amount of compression can allow liquid to wick from the first portion 61 to the third portion 63 via the compressed second portion 62, particularly owing to the uncompressed material in the third portion.

Further, the wick need not have an end which is enlarged in the plane of the wick compared to the width of the third portion associated with the vapor-generating element. The wick may instead have a substantially constant width along its end-to-end length. A heating coil might be wrapped around the third portion, but such a shape, which allows a greater relative width for the third portion can also conveniently be used with other vapor-generating elements.

Figure 12:
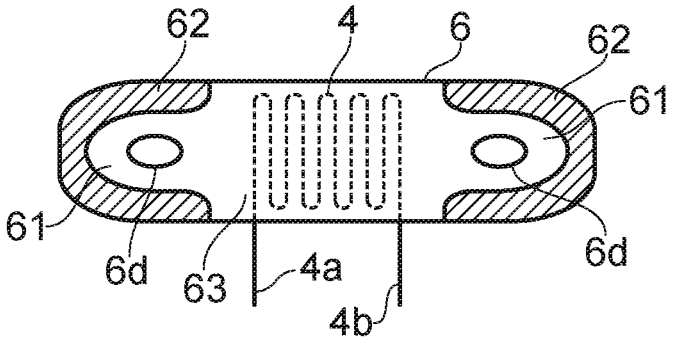
FIG. 12 shows a plan view of a further example atomizer.

FIG. 12 shows a schematic plan view of an example wick and heater assembly in which the wick 6 has a substantially constant width, and lacks enlarged ends. The heater 4 in this case is configured as an embedded heater, comprising a serpentine wire with many loops embedded within the material of the wick 6 in the third portion 63.

A constant width wick with a relatively wide third portion might also be useful for delivery of liquid from a reservoir to a vapor-generating element in the form of a vibrating mesh.

In a further alternative, the wick may have a single-ended shape, comprising one first portion, one second portion peripheral to the first portion, and a third portion to convey liquid from the first portion to a vapor-generating element. This may be used with a reservoir having just one opening. Alternatively, the reservoir may have more than one opening, each delivering liquid to a different single-ended wick.

The reservoir need not be an annular shape surrounding a central airflow passage as in the FIG. 4 example. Rather, the reservoir may be any convenient shape or size and bounded by an outer wall with one or more openings overlaid by a wick first portion. Also, a single first portion of a wick may include more than one liquid receiving area if the first portion is located to overlay more than one opening in the reservoir wall.

Conveniently, the wick, in its uncompressed state, has a planar shape, meaning that its width and length are greater than its thickness, typically several or many times its thickness. A planar shape lends itself to a variety of shapes of wick, such as the examples described above, and offers a larger region over which the compression seal can extend in conjunction with a smaller dimension in the compression direction. This is not essential however, and a wick might have a non-planar shape in its uncompressed state. For example, an elongate rod shape such as a thick string or a bundle of fibers may have a sufficiently extensive width or diameter to allow compression to be effectively applied at one or both ends. The vapor-generating element might comprise a heating coil tightly wound to reduce the diameter in the third portion, or other heater or vapor-generating elements may be used.

Clearly, in the compression region, the wick is in contact with the wall of the reservoir. In arrangements where the first portion is larger than the opening, so that the second, compressed, portion is spaced apart from the edges of the opening, there is an expanse of the first, uncompressed, portion between the edges of the opening and the start of the compression region. If the cavity in which the wick is disposed is deeper than the thickness of the wick, there is the option of the wick surface being in contact with the reservoir wall in this expanse, or being spaced from the reservoir wall. Either alternative may be used, but contact between the uncompressed material and the reservoir wall can provide a capillary sealing effect. This may supplement the sealing provided by the compression of the wick in the compression region, so may be beneficial.

Figure 13A:
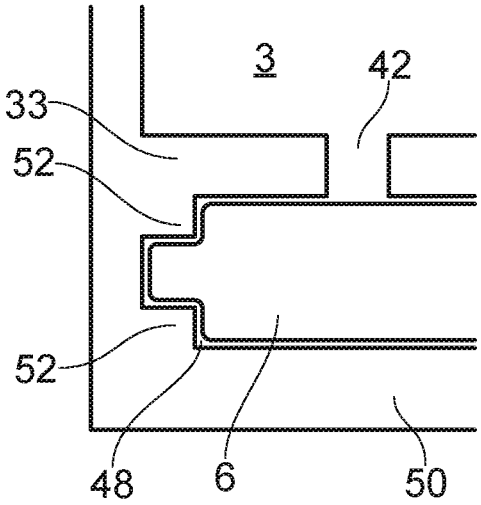
FIGS. 13A and 13B show cross-sectional side views of parts of further example vapor-generating assemblies.
Figure 13B:
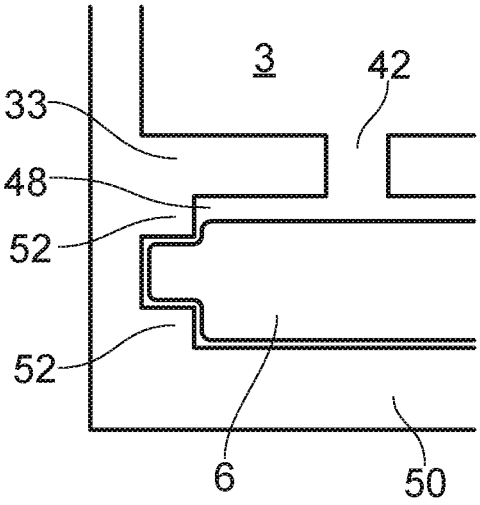

FIGS. 13A and 13B show a cross-sectional side view of wicks installed according to these two alternatives. In each case, the protruding portions 52 extending from the base wall 33 and the compression region 50 are placed so as to compress the very edges of the wick, in contrast to the FIG. 5 example where the compression region 50 is located slightly inwardly from the wick edges. In FIG. 13A, the wick 6 has the same thickness as the cavity 48 so that it is compressed by the protrusions 52 in the second portion, and has its upper surface touching the base wall 33 in the uncompressed first portion, around the opening 42. A capillary seal is formed over this area of uncompressed material of the first portion, contacting the base wall 33. In FIG. 13B, the wick 6 has a thickness less than the depth of the cavity 48, but greater than the separation of the two opposing protrusions 52. Thus, the protrusions 52 compress the wick 6 in the second portion, but the upper surface of the wick is spaced from the base wall in the uncompressed first portion. A lesser or no capillary sealing effect is provided.

As noted, the compression of the wick comprises a squashing or squeezing of the wick material when the wick is in its installed location, that reduces the thickness of the wick at the position of the squeezing compared to the thickness of the wick when no compression is applied. The compression is applied along the thickness direction of the wick, which, regardless of wick shape, is a direction which will typically be substantially orthogonal or perpendicular to a plane in which liquid moves in the wick from the liquid receiving area in the first portion to the vapor-generating element associated with the third portion, or to a general direction of liquid flow from the liquid receiving area to the third portion. For a planar wick, having a thickness generally significantly less than the width and length, the compression is therefore orthogonal to the plane of the wick.

The amount of compression should be enough to produce a desired level of compression seal owing to the closed pores or reduced pore size in the porous wick material. This will depend on factors such as the type of wick material, the pore size and pore density (porosity), the thickness of the wick and the viscosity of the source liquid.

We can define the amount of compression in terms of the amount by which the wick thickness along the compression direction is reduced by the compression, compared to the uncompressed thickness. The compression may be applied from one side only or from both sides.

Figure 14:
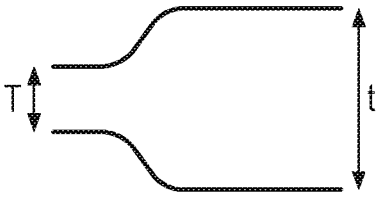
FIG. 14 shows a cross-sectional side view of part of a wick indicating parameters of interest.

FIG. 14 is a schematic side view depiction of part of a wick showing the parameters of interest. The uncompressed part of the wick has a thickness t, and the compressed part of the wick has a thickness T. Since the compression reduces the wick thickness, but will not reduce it to nothing, the compressed thickness T is always less than the uncompressed thickness t, so that $0<T<t$, and $0<T/t<1$. Typically, the compression may reduce the thickness to a half or less of its uncompressed value, for example down to about one tenth of the uncompressed value. Therefore, $0.1<T/t<0.5$ in some examples. Other ranges for the T/t ratio are $0.1<T/t<0.4$; $0.1<T/t<0.3$; $0.1<T/t<0.2$; $0.2<T/t<0.5$; $0.2<T/t<0.4$; $0.2<T/t<0.3$; $0.3<T/t<0.5$ and $0.3<T/t<0.4$. Larger values for the T/t ratio are not excluded however, so that $0.1<T/t<0.6$; $0.1<T/t<0.7$; $0.1<T/t<0.8$ or $0.1<T/t<0.9$. Similarly, more significant compression might be employed, so that $0<T/t<0.1$.

As described thus far, the compression of the wick has been effected by squashing it between two opposing surfaces which are integral to the structure of the electronic cigarette. If the wick material is resilient or elastic, this compression is not permanent and the wick will revert to its original thickness if removed from its location overlying the reservoir opening. However, other methods of compression may also be used if advantageous. For example, techniques that give a permanent, irreversible reduction in the wick thickness may be used.

Adhesive might be applied to the wick material in the second portion of the wick and/or to the reservoir wall around the opening, and the wick placed in position across the opening. Before the adhesive dries, compression is applied to the second portion for example by pressing a specially shaped tool that matches the shape of the second portion into the wick material, to close up the pore structure. If the adhesive penetrates the porous structure under this pressure, when the adhesive dries (perhaps by curing under the action of ultraviolet light or similar), the wick will be stuck in place against the reservoir wall in the second portion, and the pore structure in the second portion will be retained in the compressed state. There is no particular requirement for a compression body in this arrangement, although a surface on the opposite face of the wick from the reservoir wall may be useful in containing any leaked liquid.

Depending on the material used for the wick, a similar result may be achieved by the application of energy to soften or melt the material of the wick in the second portion, either during or immediately before compression of the second portion so that the material becomes fused into a compressed state. If the reservoir wall is made from a suitable material such as a plastics material, the wick may be fused to the wall in the same procedure. Heat might be applied by application of a heated tool pressed against the second portion of the wick when the wick has been positioned over the opening, for example. A laser beam might be directed onto the wick material to provide the required energy to melt the wick material, and application of a tool could then be used to compress the softened material of the second portion.

A variety of porous materials may be used for a wick according to the present disclosure. The material should have an appropriate porosity to provide the required wicking rate (liquid delivery rate) for the source liquid or liquids with which it is envisaged to be used, and be compressible by an amount that provides a useful amount of sealing. The material is therefore compliant, soft, flexible and/or non-rigid. For a planar wick, any such material that can be formed into a sheet or mat may be used. The sheet might have the form of a fabric, being either woven or non-woven. For example, the sheet could be formed from fibers comprising natural materials such as cotton, wool, cellulose or linen, or from artificial materials such as various polymers and plastics. Ceramics and glass fibers may also be used. Also, the sheet could comprise a foamed or sponge material (include natural and man-made sponges). The wick shape may be cut or stamped from a larger sheet of the wick material. As noted, the wick need not have a planar form, so that ropes, strings or bundles of fibers might be used. Two or more materials might be included in a single wick, for example by combining or mixing fibers of different materials or composition.

In conclusion, in order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein. The disclosure may include other inventions not presently claimed, but which may be claimed in future.

The invention claimed is:

1. An aerosol source for a vapor provision system comprising:

a vapor-generating element;

a reservoir for holding source liquid, the reservoir being bounded by a wall having an opening therein; and a liquid transport element comprising a first portion arranged to receive the source liquid from the reservoir via the opening, a second portion peripheral to the first portion, and a third portion arranged to deliver the source liquid from the first portion to the vapor-generating element;

wherein at least part of the second portion is compressed against a section of the wall around the opening, in use, to provide a sealing effect around at least part of the first portion to promote movement of the source liquid towards the vapor-generating element; and wherein the liquid transport element has a thickness t, and the second portion is compressed in a direction of the thickness t to a compressed thickness T less than the thickness t.

2. The aerosol source according to claim 1, wherein the second portion is compressed such that $0.1<T/t<0.5$.

3. The aerosol source according to claim 1, wherein the first portion is the same as the third portion, coincident with the third portion, overlaps with the third portion, or is contiguous with the third portion.

4. A cartomizer for a vapor provision system comprising the aerosol source according to claim 1.

5. A vapor provision system comprising the aerosol source according to claim 1.

6. The aerosol source according to claim 1, comprising a compression body providing a first surface facing a second surface of the wall of the reservoir, the first surface and the second surface spaced apart to define a cavity in which the liquid transport element is accommodated.

7. The aerosol source according to claim 6, wherein at least part of the first surface and the second surface are spaced apart to define the cavity with a depth which is less than a thickness of the liquid transport element so as to compress the second portion when the liquid transport element is accommodated in the cavity.

8. The aerosol source according to claim 7, wherein one or both of the first surface and the second surface has a protrusion extending into the cavity to locally reduce the depth of the cavity to less than the thickness of the liquid transport element.

9. The aerosol source according to claim 1, wherein the first portion extends beyond the opening in the wall of the reservoir such that the second portion is spaced apart from a perimeter of the opening.

10. The aerosol source according to claim 9, wherein at least part of the first portion is in contact with a surface of the wall around the opening to provide a capillary sealing effect.

11. The aerosol source according to claim 1, wherein the liquid transport element has a planar shape with a width and a length in a plane orthogonal to a direction of compression of the second portion, and a thickness in the direction of compression of the second portion which is less than the length.

12. The aerosol source according to claim 11, wherein the thickness of the liquid transport element in the direction of compression of the second portion is less than the width of the liquid transport element.

13. The aerosol source according to claim 11, wherein the liquid transport element has an end part including the first portion and the second portion, the end part having a width which is greater than a width of the third portion.

14. The aerosol source according to claim 1, wherein the liquid transport element has a length in a plane orthogonal to a direction of compression of the second portion, and has two end parts each including a first portion and a second portion, the two end parts being arranged on either side of the third portion along the length of the liquid transport element.

15. The aerosol source according to claim 14, wherein the reservoir has an annular shape bounded by a wall comprising an end wall having two openings oppositely disposed across a diameter of the annular shape, the liquid transport element being arranged such that each of the first portions of the two end parts receives the source liquid via one of the two openings, and each of the second portions of the two end parts is compressed against a section of the end wall around one of the two openings.

16. A vaporizer for a vapor provision system comprising:

a vapor-generating element for generating vapor from a liquid; and a liquid transport element comprising a first portion configured to receive the liquid from a reservoir via an opening in a wall of the reservoir, a second portion peripheral to the first portion and configured for compression against a section of wall around the opening, and a third portion configured to deliver the liquid from the first portion to the vapor-generating element, wherein the liquid transport element has a thickness t, and the second portion is configured to be compressed in a direction of the thickness t to a compressed thickness T less than the thickness t.

17. A liquid transport element for a vapor provision system comprising:

a first portion configured to receive liquid from a reservoir via an opening in a wall of the reservoir, a second portion peripheral to the first portion and configured for compression against a section of wall around the opening; and a third portion configured to deliver the liquid from the first portion to a vapor-generating element configured to generate vapor from the liquid, wherein the liquid transport element has a thickness t, and the second portion is configured to be compressed in a direction of the thickness t to a compressed thickness T less than the thickness t.

18. A vapor provision system comprising:

a reservoir containing liquid;

a vapor generator; and a wicking element arranged to transport the liquid from the reservoir to the vapor generator for vaporization to generate a vapor for user inhalation, the wicking element comprising a first section arranged to receive the liquid from within the reservoir and a second section arranged to provide the liquid to the vapor generator;

wherein the first section of the wicking element comprises a flat surface compressed against a section of a wall of the reservoir around an opening in the wall through which the first section receives the liquid, in use, so the compressed portion of the wicking element forms a seal at least partially around the opening, wherein the liquid transport element has a thickness t, and the compressed portion is compressed in a direction of the thickness t to a compressed thickness T less than the thickness t.

* * * * *